United States Patent [19]

Yamanaka et al.

[11] 4,383,231

[45] May 10, 1983

[54] TEMPERATURE SWITCH HAVING A MAGNETICALLY SOFT AMORPHOUS METAL MEMBER

[75] Inventors: Minoru Yamanaka, Toyota; Mitsuyuki Suzuki, Gamagoori; Hideo Haneda, Toyota; Masatoshi Kato, Kariya; Masataka Ohtsuki, Toyota, all of Japan

[73] Assignee: Aisin Seiki Kabushiki Kaisha, Kariya, Japan

[21] Appl. No.: 297,193

[22] Filed: Aug. 28, 1981

[30] Foreign Application Priority Data

Aug. 29, 1980 [JP] Japan ..... 55-120101

[51] Int. Cl.[3] ..... H01H 61/00

[52] U.S. Cl. ..... 335/146; 335/208; 337/344

[58] Field of Search ..... 337/54, 90, 134, 344, 337/366, 336, 371; 335/146, 208

[56] References Cited

U.S. PATENT DOCUMENTS

| | | | |
|---|---|---|---|
| 2,272,021 | 2/1942 | Riche | 337/344 |
| 2,707,215 | 4/1955 | Chinn | 337/344 X |
| 2,802,921 | 8/1957 | Miklas | 337/344 |
| 3,760,310 | 9/1973 | Carson | 335/146 |
| 4,039,993 | 8/1977 | Kerr | 337/344 |
| 4,266,211 | 5/1981 | Ulanet | 335/208 |

FOREIGN PATENT DOCUMENTS

| | | | |
|---|---|---|---|
| 1160925 | 1/1964 | Fed. Rep. of Germany | 335/146 |

*Primary Examiner*—George Harris

*Attorney, Agent, or Firm*—Oblon, Fisher, Spivak, McClelland & Maier

[57] ABSTRACT

A temperature switch includes a housing, a fixed contact positioned in the housing, a movable contact member mounted in the housing carrying a movable contact and urged to first and second positions where the movable contact is in abutment with or displacement from the fixed contact, respectively, a permanent magnet mounted in the housing, a thermally sensitive member mounted in the housing so as to be exposed to a region the temperature of which is to be determined wherein the thermally sensitive member includes a magnetically soft, amorphous metal member and is magnetically coupled to the permanent magnet, and an operating member which includes magnetic material wherein a first end thereof engages the movable contact member and a second end thereof opposite the first end is attracted to the thermally sensitive member against the resilience of the movable contact member, thereby causing displacement of the movable contact to the second position and wherein the thermally sensitive member includes a paramagnetic body upon the temperature of the region exceeding the Curie point thereof so as to displace the movable contact to the first position.

8 Claims, 2 Drawing Figures

TEMPERATURE SWITCH HAVING A MAGNETICALLY SOFT AMORPHOUS METAL MEMBER

BACKGROUND OF THE INVENTION

1. Field of the Invention

The invention relates to a temperature switch which produces a switch operation in response to temperature change.

2. Description of the Prior Art

In a conventional arrangement of the type described, a bimetal is used as a thermally sensitive member. However, the stroke through the bimetal which moves in response to a temperature change has been found to remain a small value, and the response of the bimetal has been dissatisfactory, resulting in reduced accuracy of switch operation.

SUMMARY OF THE INVENTION

In view of the foregoing, based on the recognition that a magnetically soft, amorphous metal changes to a paramagnetic material above a temperature corresponding to the Curie point thereof, an object of the invention is to provide a temperature switch capable of providing accurate switch operation in response to the temperature of a region, the temperature of which is to be determined. Accordingly, a magnetically soft, amorphous metal is utilized to form a thermally sensitive member, thus assuring reliable switch operation in response to a change in the characteristic of the amorphous metal. Because such amorphous metal has excellent corrosion resistance, it may be safely exposed to the region.

In accordance with the present invention, a temperature switch is provided which includes a housing, a fixed contact positioned in the housing, a movable contact member mounted in the housing carrying a movable contact and urged to first and second positions where the movable contact is in abutment with or displaced from the fixed contact, respectively, a permanent magnet mounted in the housing, a thermally sensitive member mounted in the housing so as to be exposed to the region the temperature of which is to be determined wherein the thermally sensitive member includes a magnetically soft, amorphous metal member and is magnetically coupled to the permanent magnet and an operating member which includes magnetic material wherein a first end thereof engages the movable contact member and a second end thereof opposite the first end is attracted to the thermally sensitive member against the resilience of the movable contact member, thereby causing displacement of the movable contact to the second position and wherein the thermally sensitive member is a paramagnetic body upon the temperature of the region exceeding the Curie point thereof so as to displace the movable contact to the first position.

BRIEF DESCRIPTION OF THE DRAWINGS

Various objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
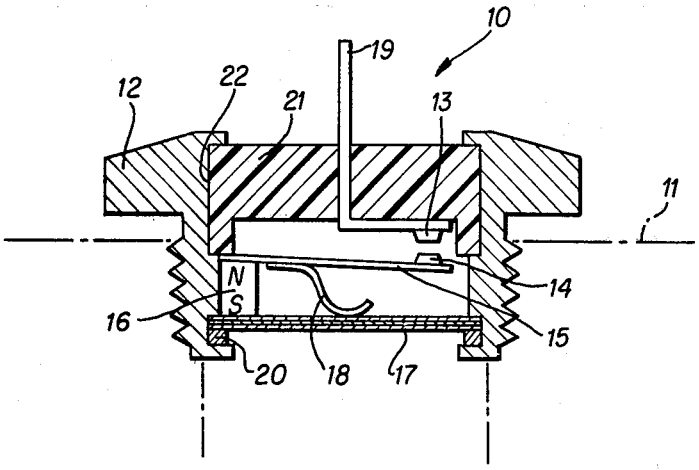
FIG. 1 is a cross sectional view illustrating one embodiment of the present invention, also illustrating the switch in its open condition.
Figure 2:
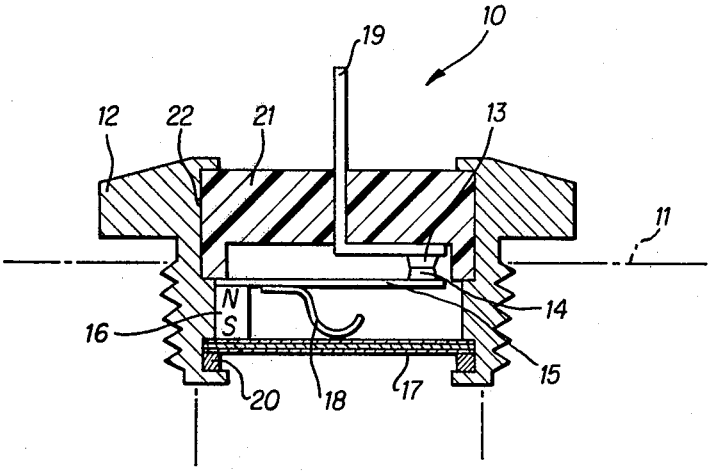
FIG. 2 is a cross sectional view similar to FIG. 1 illustrating the closed position of the switch of the present invention.

In FIGS. 1 and 2, a temperature switch is generally shown by reference number 10, and includes a housing 12 which may be formed of brass, for example, and which is threadably engaged with a water jacket 11 of an automobile radiator. Mounted within housing 12 is a fixed contact 13, a movable contact member 15 integrally carrying a movable contact 14 at one end thereof and having a resilience characteristic which causes movable contact 14 to abut against fixed contact 13, and a permanent magnet 16.

A thermally sensitive member 17 is also provided and itself includes a plurality of sheets of a magnetically soft, amorphous metal and which is mounted on housing 12 so as to be exposed to a path of cooling water through water jacket 11 which represents a region the temperature of which is to be determined. Thermally sensitive member 17 is magnetically coupled to permanent magnet 16.

An operating member 18 is also provided and has one end thereof engaged with movable contact member 15 and an opposite end attracted to thermally sensitive member 17 against the resilience of movable contact member 15 as a result of thermally sensitive member 17 being excited by permanent magnet 16 below the Curie point, thus displacing one end of contact member 15 to cause movable contact 14 formed thereon to move away from fixed contact 13. In this manner, switch 10 is maintained in an off position.

A terminal member 19 is electrically connected to fixed contact 13. Movable contact member 15 is connected to the electrical ground through a path including housing 12 and water jacket 11.

A metal gasket 20 is provided to prevent ingress of the cooling water into housing 12. A packing member 21 is mounted in an opening 22 provided in housing 12 and provides electrical insulation between housing 12 and fixed contact 13 and also prevents ingress of dust, packing member 21 being formed of a synthetic resin material.

When the temperature of the cooling water reaches the Curie point of thermally sensitive member 17, the latter changes to a paramagnetic body and is no longer excited by permanent magnet 16. Operating member 18 then ceases to be attracted by thermally sensitive member 17 and hence the resilience of movable contact member 15 brings movable contact 14 into abutment against fixed contact 13 as shown in FIG. 2, thus maintaining switch 10 in a closed position.

A preferably magnetically soft, amorphous metal which forms thermally sensitive member 17 is a cobalt system. By changing the content of cobalt, a Curie point can be freely chosen in a range from approximately −30° C. to +300° C.

In addition to its use with the cooling water as shown in the embodiment illustrated, the temperature switch 10 of the invention can be equally used with any fluid including a liquid, gas and solid body in order to provide accurate switch operation in response to a temperature change of the object being determined. Also, the invention is not limited to the specific embodiment shown but an arrangement may be made such that movable contact member 15 is normally urged so as to maintain movable contact 15 at a position away from fixed contact 13. However, movable contact 15 can be engaged with fixed contact 13 whenever operating member 18 is attracted by thermally sensitive member 17.

As discussed above, in the arrangement of the present invention, thermally sensitive member 17 is formed of a magnetically soft, amorphous metal which changes to a paramagnetic body at or above the Curie point thereof. Thermally sensitive member 17 is magnetically coupled to permanent magnet 16 so as to be excited thereby. Reliable switch operation is directly achieved in response to the excitement and loss of excitement which occurs above the Curie point. Since the amorphous metal has an excellent corrosion resistance, thermally sensitive member 17 may be exposed to a region the temperature of which is to be determined, allowing accurate detection of the temperature of the region and hence reliable switch operation.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A temperature switch comprising:

a housing;

a fixed contact positioned in said housing;

a movable contact member mounted in said housing carrying a movable contact and urged to first and second positions where said movable contact is in abutment with or displaced from said fixed contact, respectively;

a permanent magnet mounted in said housing;

a thermally sensitive member mounted in said housing so as to be exposed to a region the temperature of which is to be determined wherein said thermally sensitive member comprises a magnetically soft, amorphous metal member and is magnetically coupled to said permanent magnet; and an operating member which comprises magnetic material wherein a first end thereof engages said movable contact member and a second end thereof opposite said first end is attracted to said thermally sensitive member against the resilience of said movable contact member, thereby causing displacement of the movable contact to the second position and wherein said thermally sensitive member comprises a paramagnetic body upon the temperature of said region exceeding the Curie point thereof so as to displace said movable contact to said first position.

2. A temperature switch as set forth in claim 1, said permanent magnet being mounted on said housing between said movable contact member and said thermally sensitive member.

3. A temperature switch as set forth in claim 1, further comprising means for magnetically coupling said thermally sensitive member to said permanent magnet.

4. A temperature switch as set forth in claim 1, further comprising a terminal member electrically connected to said fixed contact.

5. A temperature switch as set forth in claim 1, said housing having a opening provided therein and further comprising a packing member mounted in said opening.

6. A temperature switch as set forth in claim 1, further comprising a metal gasket mounted in said housing in contact with said thermally sensitive member.

7. A temperature switch as set forth in claim 1, said permanent magnet being mounted on said housing between said movable contact member and said thermally sensitive member, said housing having an opening provided therein and further comprising a packing member mounted in said opening, and further comprising:

means for magnetically coupling said thermally sensitive member to said permanent magnet;

a terminal member electrically connected to said fixed contact; and a metal gasket mounted in said housing in contact with said thermally sensitive member.

8. A temperature switch as set forth in claim 1, wherein said thermally sensitive member comprises a magnetically soft amorphous metal member.

* * * * *